US007455110B2

(12) United States Patent
Lynde

(10) Patent No.: US 7,455,110 B2
(45) Date of Patent: Nov. 25, 2008

(54) IN-SITU CREATION OF DRILLING DEFLECTOR

(75) Inventor: Gerald D. Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 232 days.

(21) Appl. No.: 11/303,087

(22) Filed: Dec. 14, 2005

(65) Prior Publication Data

US 2007/0131433 A1 Jun. 14, 2007

(51) Int. Cl.
*E21B 29/06* (2006.01)

(52) U.S. Cl. ..... 166/298; 166/55; 166/117.6; 166/384

(58) Field of Classification Search ..... None
See application file for complete search history.

(56) References Cited

U.S. PATENT DOCUMENTS

| | | | | |
|---|---|---|---|---|
| 5,636,692 | A | 6/1997 | Haugen | |
| 6,012,526 | A * | 1/2000 | Jennings et al. | 166/298 |
| 6,209,644 | B1 * | 4/2001 | Brunet | 166/297 |
| 6,488,090 | B1 * | 12/2002 | Ohmer | 166/298 |
| 2004/0011529 | A1 * | 1/2004 | McGarian et al. | 166/313 |

* cited by examiner

*Primary Examiner*—Zakiya W. Bates
(74) *Attorney, Agent, or Firm*—Steve Rosenblatt

(57) ABSTRACT

A lateral exit in a casing is formed by starting with a shaped charge to produce a semi-circular cut of about 180 degrees in the casing. A spreader tool pushes in opposed directions at opposed ends of the cut making some of the casing wall at the cut curl inwardly. A wedge shaped tool is advanced behind the curled metal to force it to collapse on itself to create a long tapered ramp that act as would a whipstock. A one trip operation is contemplated. The drill is then guided by the doubled and tapered casing wall right into the formation without having to mill a window in the casing wall.

32 Claims, 2 Drawing Sheets

IN-SITU CREATION OF DRILLING DEFLECTOR

FIELD OF THE INVENTION

The field of this invention is making lateral exits from tubulars downhole and more particularly directing a mill to make an exit with a diverter fashioned from the tubular itself as opposed to a traditional whipstock.

BACKGROUND OF THE INVENTION

Frequently in the life of a well there comes a need to create additional lateral from a main bore or other branch bores to increase production from a producing zone or to exploit new zones or for various other purposes such as fluid injection to stimulate production from other wells. When this need arises a procedure is undertaken that involves setting and anchor that can receive a whipstock and using MWD equipment as an aid to obtain proper orientation of the whipstock. The whipstock is initially connected to a series of mills that are rotated to break loose from the now anchored and oriented whipstock. The whipstock diverts the mills into the casing wall to start a window or opening in the casing for a lateral exit. Equipment has been developed to produce the window in a single trip.

Frequently, the whipstock is left in the well after the window is produced. This creates an expense for the operator as the operator must buy all service equipment left in the well. Another issue in traditional window milling operations is the cost of the service. The milling through the casing wall creates cuttings that need to be circulated out of the well. Problems with cuttings or with milling are also possible and sometimes the window is not properly formed or the lateral exit angle doesn't turn out as planned.

While eliminating all potential problems in window milling is an ideal, the present invention addresses a part of this process and seeks to find a reliable and low cost way to be able to have a suitable diverter downhole for the mills and avoid having to manufacture and run a whipstock into position. In essence, the invention addresses ways to actually use the casing itself as a diverter and position a portion thereof as such where the drilling of the lateral will not even require milling up a long window in the casing and the attendant issues of dealing with cuttings that such milling raises. As such the concept represents a dramatic departure from prior techniques of window milling and production of laterals through them.

As an example, explosives have been used to blow out a part of the casing with shaped charges such as shown in U.S. Pat. No. 5,636,692. In this case, the mill supported explosives right above a whipstock. One issue with trying to make a complete or nearly complete window with explosives has been the debris generated from the process and how to effectively remove it from the wellbore. Other attempts have simply blown through casing to create an opening in it but in so doing created a fair amount of debris that potentially undermined subsequent operations.

The present invention while using explosives reduces or eliminates such issues and finds a way to use the casing itself as a diverter while allowing the lateral to begin without having to mill up a window in the casing. The present invention also affords a way to produce a window through which a lateral can be drilled by a technique that allows a portion of the tubular to be cut and bent back on itself to from a window without the debris that characterized prior attempts to make windows with explosives, chemicals, abrasive jets or other cutting or milling tools. These and other advantages of the present invention will be more readily apparent to those skilled in the art from the description of the preferred embodiment, the drawings and claims that appear below.

SUMMARY OF THE INVENTION

A lateral exit in a casing is formed by starting with a shaped charge to produce a semi-circular cut of about 180 degrees in the casing. A spreader tool pushes in opposed directions at opposed ends of the cut making some of the casing wall at the cut curl inwardly. A wedge shaped tool is advanced behind the curled metal to force it to collapse on itself to create a long tapered ramp that act as would a whipstock. A one trip operation is contemplated. The drill is then guided by the doubled and tapered casing wall right into the formation without having to mill a window in the casing wall. Alternatively the wedge shaped tool bends the tubular on itself to create a window through which the lateral can be drilled using a bent motor sub and other known directional drilling tools.

BRIEF DESCRIPTION OF TH DRAWINGS

FIG. 5 is a section view showing the tubular being cut on top and on bottom with associated cuts in between;

DETAILED DESCRIPTION OF THE PREFERRED EMBODIMENT

Figure 1:
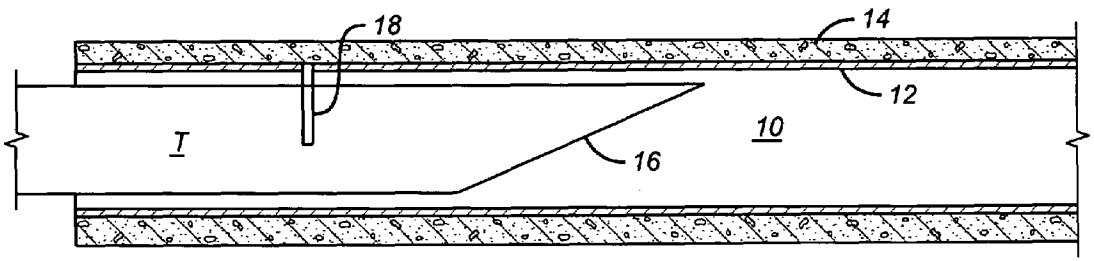
FIG. 1 is a section view of the tool showing the shaped charge cutting a semicircular slot in the casing.
Figure 2:
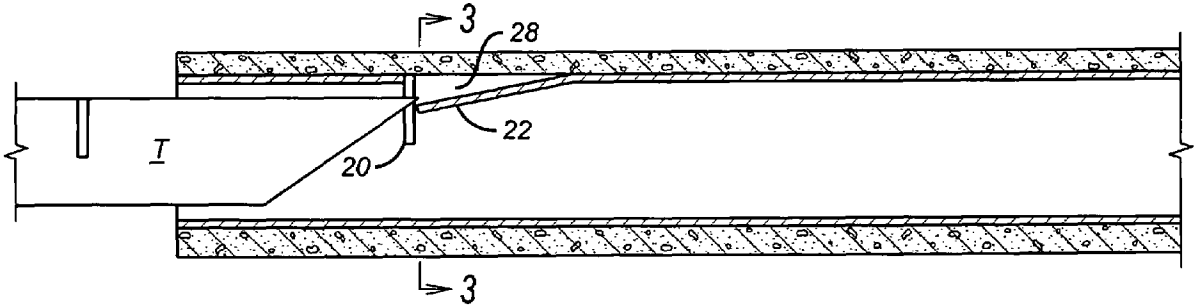
FIG. 2 shows insertion of a wedge tool behind a partially collapsed wall of the casing adjacent the slot.
Figure 4:
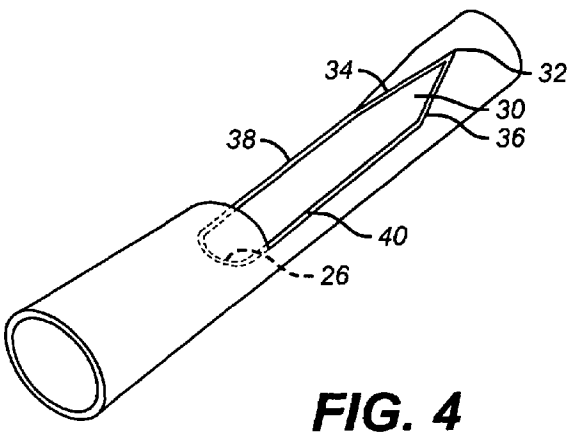
FIG. 4 is a perspective view after the wedge tool of FIG. 2 is sufficiently advanced to collapse the casing on itself to create a long sloping diversion ramp oriented into the formation.
Figure 3:
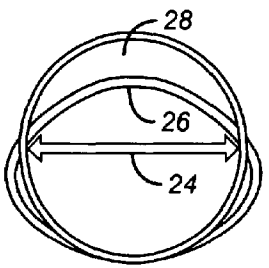
FIG. 3 is the view along lines 3-3 of FIG. 2 showing how the slot in FIG. 1 is pushed in opposed directions at it ends to create the collapsed wall shown in FIG. 2.

FIG. 1 schematically illustrates a wellbore 10 having a casing 12 with cement 14 outside the casing 12. The tool T has a tapered lower end 16 for reasons which will be explained below. A shaped linear cutter 18 is provided on the tool T that when properly oriented and triggered will make a semi-circular cut 20 as shown in FIG. 2. Those skilled in the art will appreciate that the tool T can be delivered on electric line, coiled tubing or other equivalent known conveyances to the proper depth in the wellbore 10. Similarly, the tool T can be combined with known MWD tools, not shown, or other known orientation devices to properly rotationally position the shaped charge 18 with respect to the desired exit orientation of a lateral to be drilled. Furthermore, upon having obtained the required orientation with an MWD tool or equivalent, an anchor feature in the tool T, not shown, can be deployed to hold the tool T in position as the shaped charge 18 is set off. The preferred embodiment of the shaped charge 18 is such that a semi-circular slot of about 180 degrees will be blown though the casing 12 when the charge 18 is set off. Greater or lesser included angles are contemplated as is some variation in the height of the slot made by the charge 18 in the casing 12. One objective is to be able to more easily initiate an inward deflection 22 adjacent the slot 20, as shown in FIG. 2. One way this is accomplished with tool T is schematically illustrated in FIG. 3. In essence the tool T puts opposed forces represented by arrow 24 at or near the opposed ends of the slot 20. What this does is encourage an initial inward collapse of wall 26 as the cross-section of the casing 10 goes from a circular shape to a more oval shape, as shown in FIG. 3. Since FIG. 3 is a section view looking down along lines 3-3 of FIG. 2, those skilled in the art will appreciate that gap 28 is now directly exposed to the cement 14 or the formation behind it if there is no cement or the cement has been cleared away by the firing of the charge 18. The lower tapered end 16 of the tool T can now be advanced into gap 28 to force wall 26 further back on itself, as shown in FIG. 4. As the tool T is advanced, its cylindrical portion doubles the wall 26 on itself, while the tapered leading end 16 creates a sloping surface 30 that comes to a point 32 both of which still experiencing support along edges 34 and 36 that are inclined and additionally possibly along straight edges 38 and 40. Sloping surface 30 acts as a whipstock for a drilling operation that produces a lateral through gap 28 in a known manner. One difference is that the drill that deflects off the sloping surface 30 does not have to go through the wall 26 of the casing 12 as in the past with a window milling system. In essence, the window is created by the combination of the explosive charge 18 and the tool T that together bend the wall 26 of the casing 12 back on itself while uniquely leaving a sloping surface 30 to deflect a drill or mill out of the casing 12 to drill the lateral.

In some instances particularly involving very hard formations, there may be a concern for the strength of the tapered segment 30 do its deflection duties rather than getting drilled or milled out. The rigidity of the sloping surface 30 and the loads that it sees can be varied by changing the angle of the leading end 16 of the tool T as well as the wall thickness and materials of the casing 12. Clearly, less consolidated or softer formations will present less of a concern for the use of this technique.

Another benefit of this technique is that whipstocks that are expensive to manufacture and store in a variety of sizes and deliver to a remote job location need not be used at all. The operator is also not stuck with the cost of whipstocks left in the hole. Fishing operations to retrieve whipstocks no longer are required. If desired, the tapered segment 30 can be pushed flat against the remaining casing wall opposite the lateral produced to allow access to the main bore below. Alternatively, the tapered segment 30 can be cut and retrieved or allowed to fall to the bottom of the wellbore to allow access to the main bore below. Pushing the segment flat can be done with an inflatable tool or a known spreader tool while complete removal is contemplated using available milling tools while providing a deflector to temporarily isolate the new lateral while the mill is directed straight through to remove the tapered segment 30.

Figure 5:
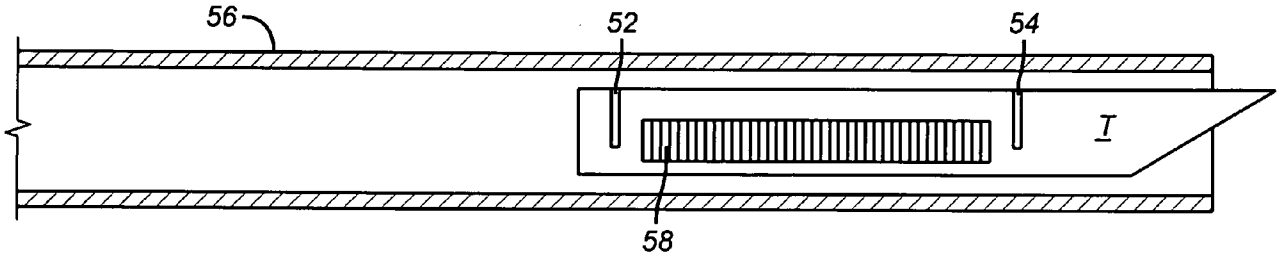
Figure 6:
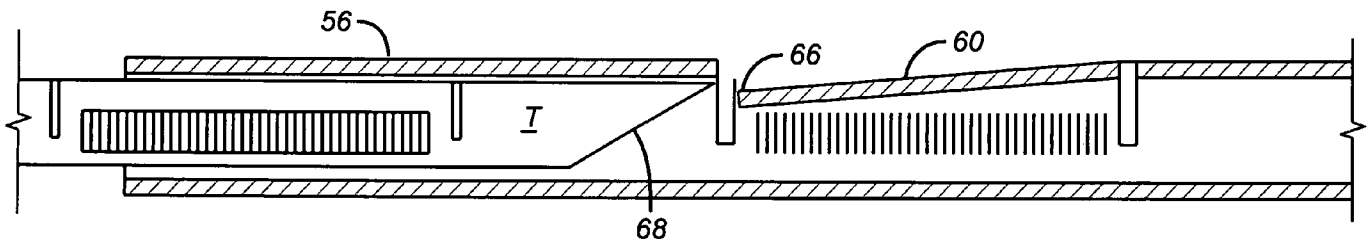
FIG. 6 is the view of FIG. 5 showing the start of folding the tubular segment on itself to create a window.
Figure 7:
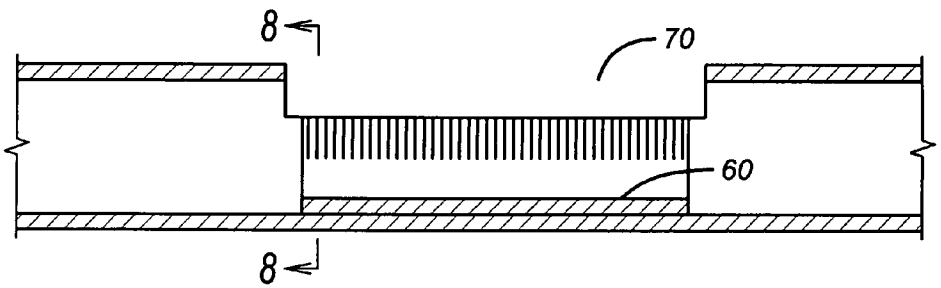
FIG. 7 is a continuation of the process from FIG. 6 showing the casing portion doubled on itself throughout its length.
Figure 8:
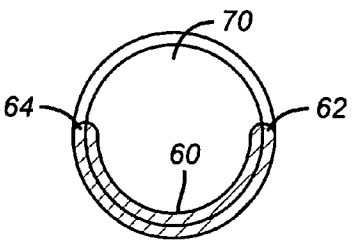
FIG. 8 is a section drawn along lines 8-8 of FIG. 7.

Referring now to FIG. 5, an alternative embodiment is described. This time, the tool T has end cutters 52 and 54 at opposed ends. In the preferred embodiment these cutters are oriented at 90 degrees to the longitudinal axis but other orientations are possible. The extent of end cutters 52 and 54 is preferably about 180 degrees but other lengths are possible and the width or even shape of the cut they make can be varied. Preferably, they are a line charge that creates a circumferential slot but they can also be individual charges in a line that either perforate the wall of casing 56 or simply score it to weaken in for subsequent operations, as will be described. In addition, stitch cutters 58 are preferably oriented in longitudinal alignment with the ends of the slots produced by end cutters 52 and/or 54. Again, they may perforate or rip through or simply score the casing 56 to simplify the next operation illustrated in FIG. 6. The stitch cutters may be a series of arc cuts that are about 30 degrees that are parallel to each other. Other configurations are envisioned that ultimately help to take a wall segment 60 and double it back on casing 56 as shown in FIGS. 6-8. Locations 62 and 64 in FIG. 8 show where the stitch cutters 58 have weakened or penetrated the wall of casing 56.

After making the cuts shown in. FIG. 5, which can be done with explosives or chemicals or jet cutting tools or equivalent known tools, the tool T is retracted and a spreading operation as previously described using tool T and shown in FIG. 3 is undertaken to create an inwardly oriented lip 66 that can then be engaged by tapered end 68 of tool T, as shown in FIG. 6. Since the preferred shape of the body of tool T is cylindrical above taper 68, advancing the tool T downhole from the position shown in FIG. 6 will peel back section 60 against the opposing wall of casing 56 and create a window 70 having a half-cylindrical shape, as more clearly seen in FIG. 8. After window 70 is produced in the manner described a drill using a bent sub can be directed out through the window 70 without need for a whipstock to drill a lateral. Those skilled in the art will appreciate that the window 70 can be produced in a direction opposite that shown in the Figures.

The above description is illustrative of the preferred embodiment and many modifications may be made by those skilled in the art without departing from the invention whose scope is to be determined from the literal and equivalent scope of the claims below.

I claim:

1. A downhole diverter apparatus for producing a lateral through a tubular, comprising:

a tubular defined by a wall and having a longitudinal axis and a wall opening that allows a portion of the tubular wall to be collapsed toward said longitudinal axis in a manner that enlarges said opening and an inclined surface integral to the tubular defined by said collapsed portion, said inclined surface extending from said now enlarged opening.

2. The apparatus of claim 1, wherein:

said opening is transverse to said longitudinal axis.

3. The apparatus of claim 2, wherein:

said opening is initially a slot.

4. The apparatus of claim 3, wherein:

said slot extends at most for 180 degrees.

5. The apparatus of claim 4, wherein:

said slot is at 90 degrees to said longitudinal axis.

6. The apparatus of claim 3, wherein:

said slot is enlarged into an elongated window as the tubular is bent back on itself starting from said slot.

7. The apparatus of claim 6, wherein:

said inclined surface is formed on a portion of said tubular that is bent back less than other portions.

8. The apparatus of claim 7, wherein:

said inclined surface is formed at a downhole end of said window.

9. The apparatus of claim 8, wherein:

said inclined surface tapers in width toward the downhole end.

10. A method of forming a whipstock downhole, comprising:

moving a portion of a tubular wall downhole toward itself to form within the tubular a tapered exit ramp for a lateral.

11. The method of claim 10, comprising:

removing said tapered exit ramp after drilling the lateral by milling it out.

12. A method of forming a whipstock downhole, comprising: creating an opening in the tubular; and peeling from said opening a portion of a tubular wall downhole toward itself to form a tapered exit ramp for a lateral.

13. The method of claim 12, comprising:

creating said opening with explosives.

14. The method of claim 12, comprising:

forming said opening as a circumferential slot.

15. The method of claim 13, comprising:

extending said opening for less than 180 degrees.

16. The method of claim 12, comprising:

deforming the tubular adjacent said opening to create an inwardly oriented lip of the tubular adjacent said opening.

17. The method of claim 16, comprising:

engaging said lip to bend a portion of the tubular back on itself.

18. The method of claim 17, comprising:

using a tool with a tapered leading end to engage said lip and to form said tapered exit ramp.

19. The method of claim 18, comprising:

using said tool in said creating said opening.

20. The method of claim 19, comprising:

using said tool in said deforming the tubular.

21. The method of claim 20, comprising:

carrying explosives on said tool to create said opening in the form of a slot;

spreading the tubular in opposed directions with said tool adjacent ends of said slot to create said lip;

using said tapered leading end to form said tapered exit ramp from the tubular.

22. The method of claim 18, comprising:

using said tool to form said tapered exit ramp in a single trip in the wellbore.

23. A method of forming a whipstock downhole, comprising:

moving a portion of a tubular wall downhole toward itself to form a tapered exit ramp for a lateral;

removing said tapered exit ramp after drilling the lateral by bending it back against the tubular wall.

24. A method of forming a window in a tubular having a longitudinal axis, comprising:

bending a portion of a wall that defines the tubular toward itself and in the direction of said longitudinal axis.

25. The method of claim 24, comprising:

weakening said wall before said bending.

26. The method of claim 25, comprising:

deforming the tubular periphery after said weakening.

27. The method of claim 26, comprising:

creating an inwardly oriented lip from said deforming.

28. The method of claim 27, comprising:

initiating said bending from said lip.

29. The method of claim 25, comprising:

weakening in at least one location transverse to the longitudinal axis of the tubular and in at least one other location substantially parallel to said longitudinal axis of the tubular.

30. The method of claim 24, comprising:

performing said bending in a single trip downhole.

31. A method of forming a window in a tubular, comprising:

bending a portion of a wall that defines the tubular toward itself;

weakening said wall before said bending;

weakening in at least one location transverse to the longitudinal axis of the tubular and in at least one other location substantially parallel to said longitudinal axis of the tubular;

performing said bending along said longitudinal weakenings located at a circumferential spacing and substantially in alignment with opposed ends of spaced transverse weakenings.

32. The method of claim 31, comprising:

said weakenings penetrate the wall of the tubular.

* * * * *